US007900905B2

(12) United States Patent
Kiriyama

(10) Patent No.: US 7,900,905 B2
(45) Date of Patent: Mar. 8, 2011

(54) POST-PROCESSING APPARATUS AND IMAGE FORMING SYSTEM HAVING THE SAME APPARATUS

(75) Inventor: Tomohiro Kiriyama, Yamanashi (JP)

(73) Assignee: Casio Computer Co., Ltd., Tokyo (JP)

( * ) Notice: Subject to any disclaimer, the term of this patent is extended or adjusted under 35 U.S.C. 154(b) by 270 days.

(21) Appl. No.: 12/012,755

(22) Filed: Feb. 5, 2008

(65) Prior Publication Data

US 2008/0237964 A1 Oct. 2, 2008

(30) Foreign Application Priority Data

Mar. 29, 2007 (JP) ..... 2007-087183

(51) Int. Cl.
*B65H 37/04* (2006.01)

(52) U.S. Cl. ..... 270/58.1; 270/58.02; 270/58.07; 270/58.08; 270/58.11; 270/58.12; 270/58.27

(58) Field of Classification Search ..... 270/58.02, 270/58.07, 58.08, 58.09, 58.11, 58.1, 58.12, 270/58.27

See application file for complete search history.

(56) References Cited

U.S. PATENT DOCUMENTS

| | | | | |
|---|---|---|---|---|
| 5,112,034 | A * | 5/1992 | Uto et al. | 270/58.12 |
| 7,111,839 | B2 * | 9/2006 | Nishimura | 270/58.23 |
| 7,396,008 | B2 * | 7/2008 | Sato et al. | 270/58.09 |
| 2004/0262832 | A1 * | 12/2004 | Kaneko | 270/58.08 |
| 2005/0062210 | A1 * | 3/2005 | Kato et al. | 270/58.08 |
| 2005/0067777 | A1 * | 3/2005 | IIda et al. | 271/303 |
| 2005/0104270 | A1 * | 5/2005 | Nishimura | 270/58.23 |
| 2006/0017210 | A1 * | 1/2006 | Sato et al. | 270/58.08 |

FOREIGN PATENT DOCUMENTS

JP 2005-170676 A 6/2005

* cited by examiner

*Primary Examiner* — Leslie A Nicholsin, III
(74) *Attorney, Agent, or Firm* — Holtz, Holtz, Goodman & Chick, PC

(57) ABSTRACT

A post-processing apparatus, including a stacker which stacks sheets, including a sheet stopping member which aligns the sheet and an urging member which urges the sheet to move toward the sheet stopping member, an accumulating section which is positioned upstream of the stacker in a sheet conveyance direction, a first sheet detection section which is positioned upstream of the accumulating section, and a control section which controls the accumulating section, based on a sheet detection signal, to superimpose a secondary sheet on a primary sheet in the accumulating section, wherein a leading section of the primary sheet is positioned toward an upstream side for a first predetermined length from a leading section of the secondary sheet, and controls the urging member to rub a leading section of the primary sheet which protrudes from the secondary sheet toward the sheet stopping member.

5 Claims, 10 Drawing Sheets

POST-PROCESSING APPARATUS AND IMAGE FORMING SYSTEM HAVING THE SAME APPARATUS

CROSS REFERENCE TO RELATED APPLICATION

This application is based on Japanese Patent Application No. 2007-087183 filed on Mar. 29, 2007 with the Japanese Patent Office, the entire content of which is hereby incorporated by reference.

FIELD OF THE INVENTION

The present invention relates to a post-processing apparatus and an image forming system having the same.

BACKGROUND OF THE INVENTION

In recent years, an image forming system has been required in the market which incorporates a post-processing apparatus to conduct various post-processing operations onto a plurality of sheets.

Concerning said post-processing apparatus, Unexamined Japanese Patent Application Publication No. 2005-170,676 discloses a post-processing apparatus which includes an sheet accumulating section which temporarily accumulates sheets, a sheet ejecting section which is positioned downstream of the accumulating section to eject a plurality of sheets accumulated in the sheet accumulating section, and a sheet stacking section which is positioned downstream of the sheet ejecting section to stack the sheets ejected from the sheet ejecting section.

The sheet accumulating section accumulates the sheets based on sheet detecting information which is sent from a sheet detecting sensor, in such way that a lower stacked recorded sheet is more advanced in the sheet conveyance direction than an upper stacked sheet, whereby the sheet ejecting section can easily catch the sheet.

Further, the sheet ejecting section receives sheets one by one in an order from bottom to top, and ejects the sheets one by one to the sheet stacking section.

Further, the sheet stacking section urges an ejected sheet one by one to move in the conveyance direction, so that a plurality of sheets is coordinated all together.

The present invention will be structured described below.

SUMMARY OF THE INVENTION

Structure 1. A post-processing apparatus, including:

a stacker which stacks sheets;

an accumulating section which is positioned upstream of the stacker and superimposes a plurality of sheets to be supplied to the stacker, and a first sheet detection section which is positioned upstream of the accumulating section to detect the sheet, wherein the stacker includes:

a sheet stopping member which coordinates the sheets, and an urging member which urges the sheet to move toward the sheet stopping member, wherein the post-processing apparatus further includes a control section which controls the accumulating section, in such a way that based on a first sheet detection signal sent from the first sheet detection section, when the sheets are to be stacked in the stacker, a leading section of a primary sheet is positioned toward an upstream side for a first predetermined length from a leading section of a secondary sheet which is superimposed on the primary sheet in the accumulating section, and the control section further controls the urging member to rub a leading section of the primary sheet which protrudes from the secondary sheet toward the sheet stopping member, and controls the urging member to move the primary sheet toward the sheet stopping member.

Structure 2. A post-processing apparatus, including:

a stacker which stacks sheets;

an accumulating section which is positioned upstream of the stacker and superimposes a plurality of sheets to be supplied to the stacker, and a second sheet detection section which is positioned downstream of the accumulating section to detect the sheet, wherein the stacker includes:

a sheet stopping member which coordinates the sheets, and an urging member which urges the sheet to move toward the sheet stopping member, wherein the post-processing apparatus further includes a control section which controls the accumulating section, in such a way that based on a first sheet detection signal sent from the first sheet detection section, when the sheets are to be stacked in the stacker, a leading section of a primary sheet is positioned toward an upstream side for a first predetermined length from a leading section of a secondary sheet which is superimposed on the primary sheet in the accumulating section, and the control section further controls the stacker in such a way that the urging member rubs a leading section of the primary sheet which protrudes from the secondary sheet toward the sheet stopping member, and that the urging section moves the primary sheet toward the sheet stopping member.

Structure 3.

An image forming system which includes said post-processing apparatus, and an image forming apparatus which supplies the sheets to said post-processing apparatus.

BRIEF DESCRIPTION OF THE DRAWINGS

FIG. 6(*b*) is a drawing to explain the operation of the first embodiment of the accumulating section.

FIG. 11(*b*) is a drawing to explain the operation of the second embodiment of the accumulating section.

FIG. 11(*c*) is a drawing to explain the operation of the second embodiment of the accumulating section.

DETAILED DESCRIPTION OF THE INVENTION

Figure 1:
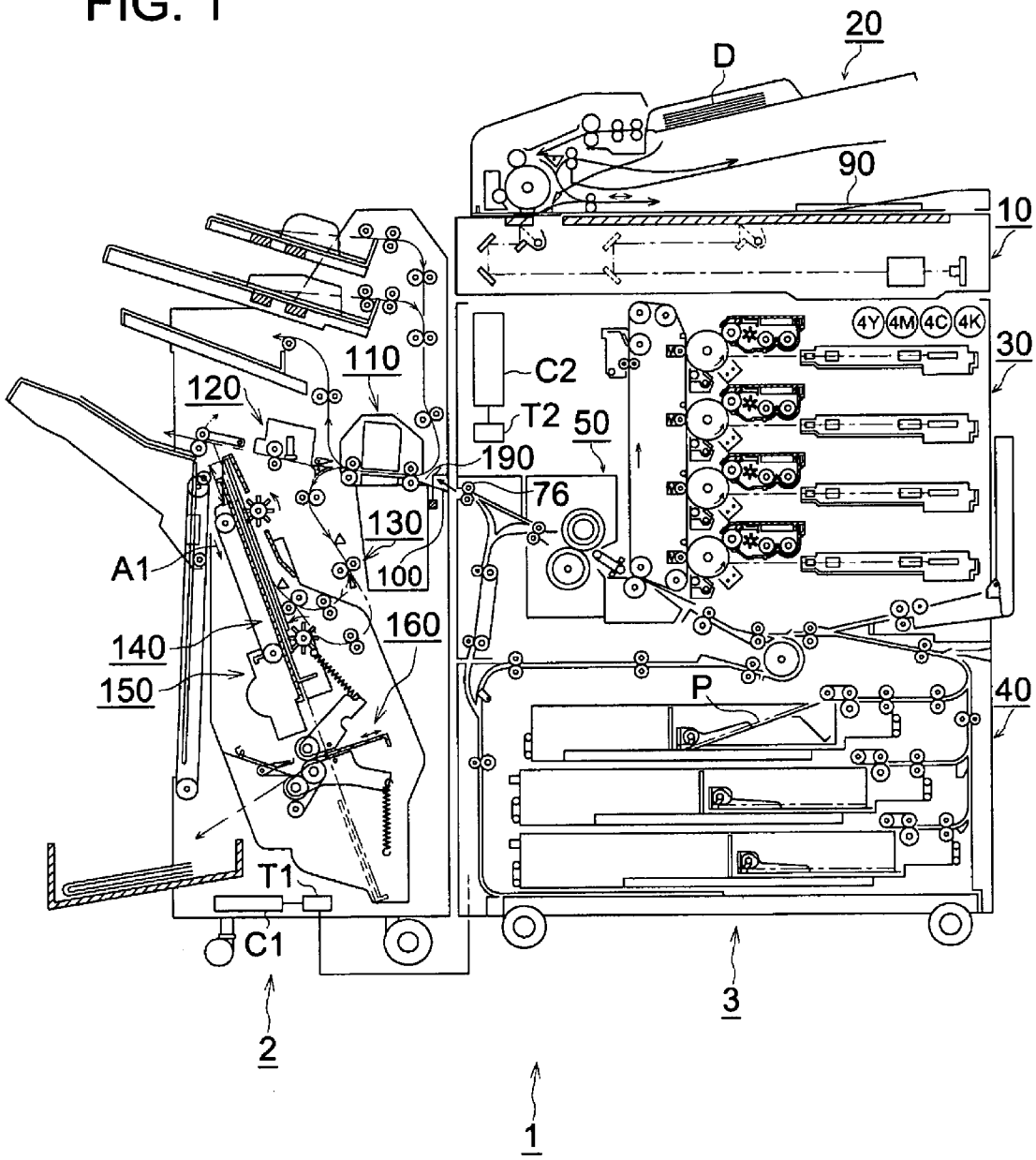
FIG. 1 is a drawing to explain an image forming system including post-processing apparatus 2 and image forming apparatus 3.

The embodiments of the present invention will now be detailed while referring to the drawings. The descriptions in this specification do not limit the technical scope of the claims nor the meaning of the terms.

FIG. 1 is a drawing to explain image forming system 1 including post-processing apparatus 2 and image forming apparatus 3.

The sheets, which can be used in image forming system 1, include paper sheets, plastic sheets and sheets of other materials. Further, the type of sheet is not limited to one size, that is, a plurality of types of the sheet can be used.

In image forming system 1, which includes image forming apparatus 3 and post-processing apparatus 2, after image formation is conducted on sheet P by image forming apparatus 3, post-processing apparatus 2 conducts post-processing operation, such as a stapling operation, onto sheet P carrying said formed image.

Image forming apparatus 3 includes document image reading section 10 which reads out a document image, automatic document feeding device 20 which conveys document D, image forming section 30 which forms an image based on document image information read out by document image reading section 10, sheet supplying section 40 which supplies sheet P to image forming section 30, fixing section 50 which fixes a toner image, operation panel 90 which incorporates a display section and various operation switches, and control section C2 which controls the above listed devices and sections.

Post-processing apparatus 2 includes hole punching section 110 which punches holes into a sheet, sheet shifting section 120 which shifts the position of the sheet for each job, stapling section 150 which staples a bundle of sheets, folding section 160 which folds said bundle of sheets, accumulating section 130 which temporarily accumulates the sheets, stacker 140 which temporarily stacks the sheets supplied from accumulating section 130, and control section C1 which controls the above listed sections.

In order that entrance section 100 of post-processing apparatus 2 successfully receives sheet P which is conveyed from image forming apparatus 3, image forming apparatus 3 and post-processing apparatus 2 are combined in such a way that paired sheet ejection rollers 76 of image forming apparatus 3 matches entrance section 100 of post-processing apparatus 2, with respect to their position and height.

Accordingly, sheet P is successfully conveyed by paired sheet ejection rollers 76 of image forming apparatus 3 to entrance section 100 of post-processing apparatus 2.

Further, since image forming apparatus 3 includes communication section T2, and post-processing apparatus 2 includes communication section T1, both apparatuses 3 and 2 are electrically connected by communication section T2 and communication section T1, which communicate various types of information.

For example, post-processing apparatus 2 conducts the post-processing operation, based on post-processing information which is communicated from image forming apparatus 3 through communication section T2 and communication section T1.

The operator sets contents of the post-processing operation by operation panel 90.

Image forming apparatus 3 and post-processing apparatus 2 of image forming system 1 will be detailed below.

Figure 2:
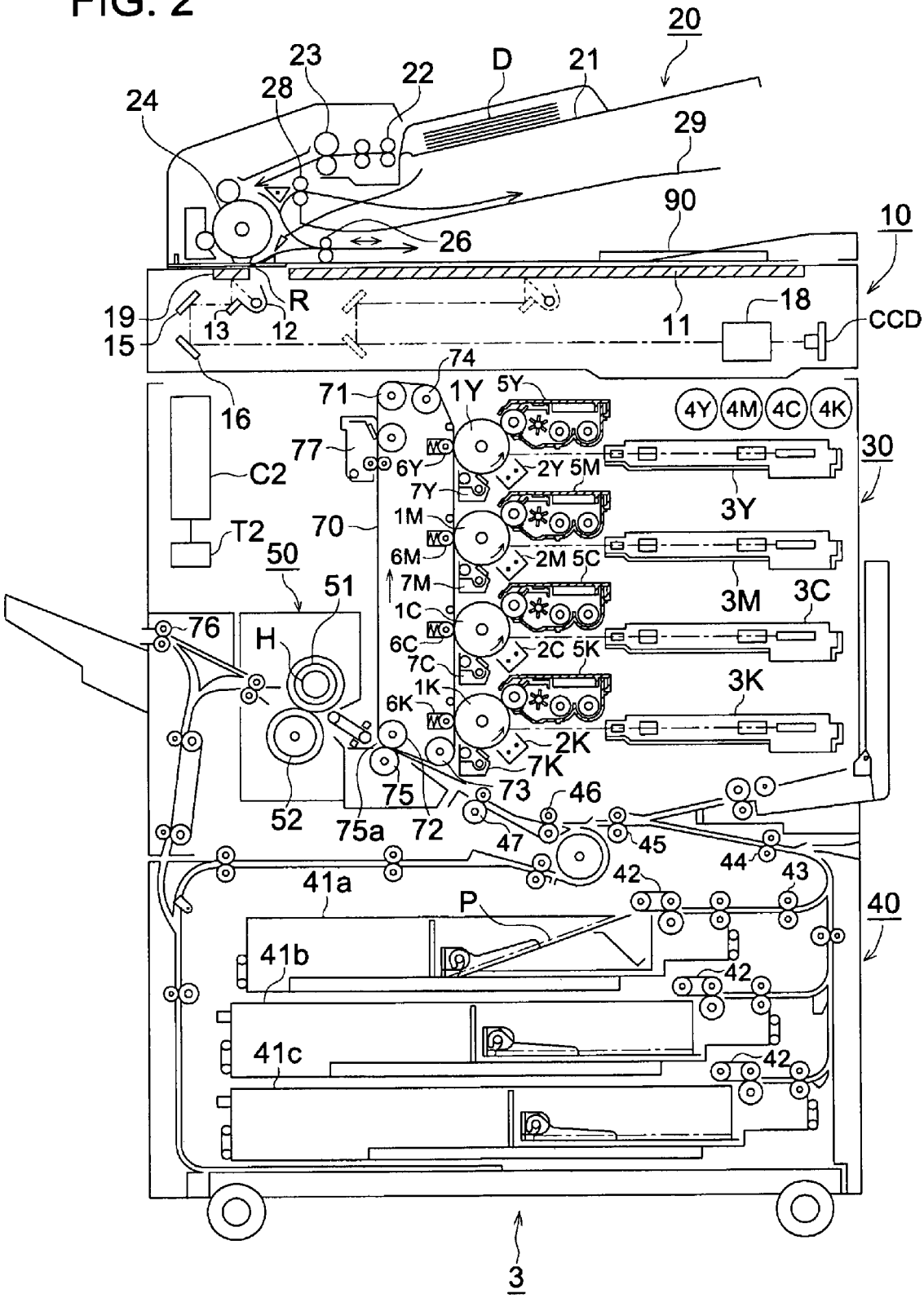
FIG. 2 is a sectional drawing of an example of the image forming apparatus.

FIG. 2 is a sectional drawing of an example of image forming apparatus 3.

As an example of the image forming apparatus, a tandem-type full-color copier, serving as the image forming apparatus, will be detailed below.

Image forming apparatus 3 includes: document image reading section 10, serving as a document image reading section, which reads out document image data to obtain specific document image information, automatic document feeding device 20, serving as an automatic document feeding means, which conveys document D to document reading area R, image forming section 30 which forms an image by an electro-photographic method, sheet supplying section 40, serving as a sheet supplying means, which supplies sheet P to image forming section 30, image fixing section 50, serving as a fixing means, which fixes a toner image onto sheet P, and control section C2, serving as a control means, which controls the above listed devices and sections.

Automatic document feeding device 20 sequentially picks up an original document D, placed on document supplying plate 21, one by one, and conveys it to document reading area R, after which automatic document feeding device 20 ejects document D onto document ejection plate 29.

To be more precise, after document D, placed on document supplying plate 21, is conveyed one by one by paired elevating feed-out rollers 22, document D is guided by rotating conveyance drum 24 exhibiting a large diameter, and is conveyed along the external surface of conveyance drum 24, whereby document D reaches document reading area R.

After document D passes through document reading area R, document D is ejected onto document ejection plate 29 by paired ejection rollers 28.

Document image reading section 10 reads out the image of document D conveyed by automatic document feeding device 20, or an image of document D placed on glass platen 11.

When a stationary optical system reading function is used for reading out the image of document D conveyed to document reading area R, light source 12 illuminates the image of document D, conveyed to document reading area R, through slit glass 19, the light reflected from the image of document D is concentrated onto line image sensor CCD through first mirror 13, second mirror 15, third mirror 16, and focusing lens 18.

It is also possible to read out the image of document D, placed on glass platen 11, by a moving optical system reading function, without using automatic document feeding device 20.

Analog signals of the image of document D, which have been photo-electrically converted by line image sensor CCD, are changed to digital image data of yellow (Y), magenta (M), cyan (C) and black (K), via an analog process, A/D conversion, shading correction, and image compression, which are conducted by an image processing section, which is not illustrated.

Photoconductor drums (hereinafter referred to as "photoconductors") 1Y, 1M, 1C and 1K, serving as first image carriers for each respective color Y, M, C and K, are electrically charged by charging device 2Y, 2M, 2C and 2K, respectively.

Exposure devices 3Y, 3M, 3C and 3K, each working for each color, form a latent image on photoconductors 1Y, 1M, 1C and 1K, based on digital image data of each color.

Each colored toner is supplied to developing devices 5Y, 5M, 5C and 5K by toner supplying devices 4Y, 4M, 4C and 4K, working for supplying respective new color toner, whereby the latent images of each color, formed on photoconductors 1Y, 1M, 1C and 1K, are developed by developing devices 5Y, 5M, 5C and 5K.

Developing devices 5Y, 5M, 5C and 5K, as well as photoconductors 1Y, 1M, 1C and 1K, are cascade-aligned in the vertical direction. To the left of FIG. 2 of photoconductors 1Y, 1M, 1C and 1K, rotatable intermediate transfer body 70, serving as a second image carrier, being a semi-conductive endless belt, is entrained about rollers 71, 72, 73 and 74.

Intermediate transfer body 70 is rotated by roller 71 which is driven by a not-illustrated driving device, in the arrowed direction.

First transfer rollers 6Y, 6M, 6C and 6K, serving as the first transfer means, are selected to be driven by control section C2, based on the type of the image, and first transfer rollers 6Y, 6M, 6C and 6K press intermediate transfer body 70 against photoconductors 1Y, 1M, 1C and 1K, respectively.

That is, after the toner images of each color are formed on photoconductors 1Y, 1M, 1C and 1K, by developing devices 5Y, 5M, 5C and 5K, respectively, said formed toner images are successively transferred and synchronously superposed onto rotating intermediate transfer body 70 by first transfer rollers 6Y, 6M, 6C and 6K, respectively, so that a full color image is formed.

After first transfer rollers 6Y, 6M, 6C and 6K transfer the toner image of each color onto intermediate transfer body 70, photoconductors 1Y, 1M, 1C and 1K are cleaned by cleaning device 7Y, 7M, 7C and 7K, so that any remaining toner is removed.

Sheet supplying section 40, serving as a sheet supplying means, includes first sheet supplying cassette 41*a*, second sheet supplying cassette 41*b*, and third sheet supplying cassette 41*c*, all of which are sheet storing members, in which varying sizes of sheets P are stored.

After an individual sheet P is picked up by sheet supplying unit 42, serving as a sheet pick-up means, sheet P is conveyed to secondary transfer area 75*a* via paired intermediate rollers 43, 44, 45 and 46, and paired registration rollers 47, so that the full color toner image, precisely superposed on intermediate transfer body 70, is transferred onto sheet P by secondary transfer roller 75.

Sheet P, carrying the full color toner image, is permanently fixed by fixing section 50, which includes heat roller 51 having heat source H, and pressing roller 52, after which said sheet P is nipped by paired sheet ejection rollers 76, and is sent through ejection outlet to the post-processing apparatus which serves as a downstream apparatus of the image forming system.

After the full-color image is transferred onto sheet P by secondary transfer roller 75, sheet P is separated from intermediate transfer body 70, whereby any remaining toner on intermediate transfer body 70 is cleaned by cleaning section 77.

Operation panel 90 is installed on the top surface of document image reading section 10, which includes a touch-sensitive panel and various operation switches.

Control section C2, for controlling image forming apparatus 3, allows the touch-sensitive panel of operation panel 90 to display selection keys of post-processing operations, and also allows communication section T2 to send post-processing information (such as information of the stapling operation), selected by the selection key toward communication section T1 of post-processing apparatus 2, other than the above described image forming operation. In addition, the post-processing operation includes a stapling operation, a folding operation, a hole-punching operation, a book-binding operation, and the like.

Figure 3:
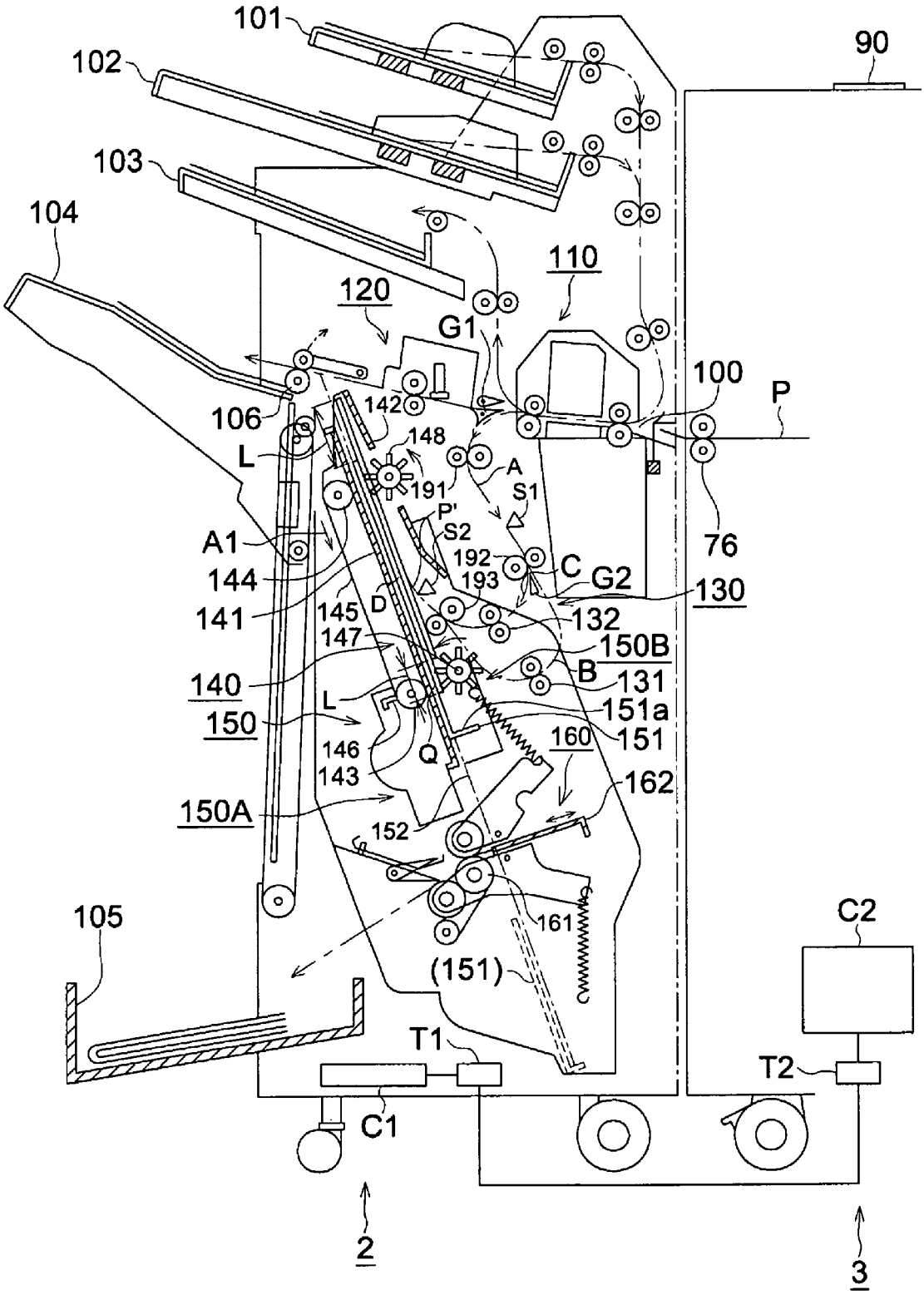
FIG. 3 is a sectional drawing of an example of the post-processing apparatus.

FIG. 3 is a sectional drawing of an example of post-processing apparatus 2.

In FIG. 3, mounted on the top position of post-processing apparatus 2, are first sheet supplying tray 101, second sheet supplying tray 102, and stationary sheet supplying tray 103, which receives the ejected sheets.

In the middle position of post-processing apparatus 2, hole-punching section 110, serving as a hole-punching means, sheet-shift section 120, serving as a sheet-shifting means, and sheet ejection roller 106 are horizontally aligned.

At the lower position of post-processing apparatus 2, accumulating section 130 which shifts succeeding sheet positions in the conveyance direction to superimpose the sheets, stacker 140 which stacks and temporarily stores sheets P, staple section 150 which serves as a stapling means, and folding section 160 which serves as a folding means, are aligned at an angle to the horizontal.

Further, on the left side of FIG. 3, arranged are elevating sheet-ejection tray 104 which stacks sheets P, on which the shifting process has been conducted, or the sheet bundle on which the stapling process has been conducted, and stationary sheet-ejection tray 105 which stacks the three-folded or two-folded sheet bundles.

When the hole-punching process is selected for sheets P which already carry a formed image, formed by image forming apparatus 3, and which were sent to receiving section 100 of post-processing apparatus 2, said sheets P are punched by hole-punching section 110, after which said sheets P pass through the upper route of first switching gate G1, and are ejected onto elevating sheet-ejection tray 104 by ejection roller 106.

When the sheet-sorting process is selected as the post-processing operation, after sheets P pass through the upper route of first switching gate G1, sheets P which are grouped in one unit are shifted perpendicular to the sheet conveyance direction. Subsequently, sheets P are ejected onto elevating sheet-ejection tray 104 by ejection roller 106.

When the sheet-stapling process is selected as the post-processing operation, after sheets P pass through the lower route of first switching gate G1, the conveyance-directional position of the succeeding sheets are shifted at a predetermined length by accumulating section 130. Then a sheet bundle, including the superimposed sheets whose positions are shifted at the predetermined length, is supplied to stacker 140.

Next, leading section urging roller 147 of stacker 140 rubs the shifted portion, being a protruded section, to move toward movable stopper 151, whereby the sheets P are stopped by sheet stopping surface 151*a*, and stacked in stacker 140.

Subsequently, the sheet bundle, aligned in the conveyance direction, is stapled by stapling section 150, after which said sheet bundle is ejected onto elevating sheet-ejection tray 104 by ejection roller 106 through stacker 140.

When the sheet-folding process is selected for sheet P as the post-processing operation, after sheets P are stapled, movable stopper 151 is lowered so that the center of the stapled sheet bundle just meets pushing member 162 of folding section 160.

Next, pushing member 162 is driven to push the center of the sheet bundle so that the sheet bundle is sandwiched between rotating paired folding rollers 161, that is, the sheet bundle is folded by this operation, after which the folded sheet bundle is ejected onto stationary sheet-ejection tray 105 by ejection roller 106 through stacker 140.

In the various cases above, the selected post-processing operation is recognized by control section C1, through communication section T2 of image forming apparatus 3 and communication section T1 of post-processing apparatus 2.

Control section C1 of post-processing apparatus 2 controls all the above described operations of post-processing apparatus 2, and also communicates with control section C2 of image forming apparatus 3, through communication section T2 of image forming apparatus 3 and communication section T1 of post-processing apparatus 2.

For example, through communication section T1, control section C1 receives post-processing information (for example, the stapling process is going to be conducted), which is selected by the post-processing key, touched by the operator on operation panel 90 of image forming apparatus 3, and control section C1 conducts the selected post-processing process.

Next, the operations of accumulating section 130 and stacker 140 will be detailed, as an example of the stapling process and the folding process.

After sheet P is conveyed to first conveyance route A through first switching gate G1, sheet P is conveyed to accumulating section 130, by paired conveyance rollers 191 and paired registration rollers 192.

Subsequently, sheets P are superimposed, while each of two sheets P is shifted relative to each other for length L in the sheet conveyance direction, which will be detailed later. Sheet bundle P' including two-superimposed sheets which are shifted from each other for length L in the sheet conveyance direction, are conveyed by paired conveyance rollers 193 to an upper space of slanting stacker 140, after which sheet bundle P' is dropped onto slanting chute 141 of stacker 140, or dropped onto a foregoing sheet bundle stacked on slanting chute 141.

In this case, the sheet conveyance direction on fourth conveyance route D, which passes through accumulating section 130, is directed upward in FIG. 3. However, after the sheet is dropped on slanting chute 141 of stacker 140 or dropped on the foregoing sheet stacked on slanting chute 141, the sheet is urged by an after-mentioned urging roller, that is, the sheet is conveyed downward in FIG. 3, being different from the sheet conveyance direction in fourth conveyance route D.

Accordingly, concerning the conveyance direction, the downstream side of the sheet conveyed on fourth route D, is opposite to the downstream side of the sheet to be stacked into stacker 140.

Thus, sheet bundle P', conveyed to the upper space of stacker 140, is conveyed obliquely downward by the urging roller on the slanting surface of slanting chute 141.

Stacker 140 includes paired width adjusting members 142, movable stopper 151 which serves as a stopping member to adjust the position of sheet P in the sheet conveyance direction, leading section urging roller 147, which serves as a first urging member, to move sheet P toward movable stopper 151, and trailing section urging roller 148, serving as a second urging member, which is located farther from movable stopper 151 than leading section urging roller 147 and rubs the substantially-central portion of sheet P to allow it to drop toward movable stopper 151.

Both leading section urging roller 147 and trailing section urging roller 148 urge sheet P to have it drop toward sheet stopping surface 151*a* of movable stopper 151, and said both rollers have plural paddles 147*a* and 148*a* on their rotation shaft.

When each urging roller rotates, top sections of paddles 147*a* and 148*a* rub down the surface of sheet P pushing it toward sheet stopping surface 151*a* so that sheet P is urged downward. Paddles 147*a* and 148*a* are formed of a thin and flexible rubber.

Sheet bundle P', including two-ply sheets P which are an upper sheet as the secondary sheet, and a lower sheet as the primary sheet, slides down on the slanting surface of slanting chute 141, wherein the leading section of the primary sheet protrudes for length L toward movable stopper 151 from the leading section of the secondary sheet in the sheet dropping direction.

When the leading section (shown by shift length section Q in FIG. 3) of the primary sheet is rubbed by leading section urging roller 147, the primary sheet is urged by leading section urging roller 147 to move toward movable stopper 151, while the secondary sheet does not disturb the movement of primary sheet, the leading section of the primary sheet is rubbed downward so that the primary sheet drops and is stopped by stopping surface 151*a*.

Then, the substantially-central portion of the second sheet superimposed on the primary sheet is urged to drop by trailing section urging roller 148, which rotates in the arrowed direction, whereby the secondary sheet superimposed on the primary sheet drops toward movable stopper 151.

Then, the leading section of both the primary sheet and the secondary sheet are rubbed by leading section urging roller 147, the substantially-central portion of both the primary sheet and the secondary sheet are rubbed by trailing section urging roller 148, whereby the top (which faces downward in FIG. 3) of each sheet touches stopping surface 151*a* so that each sheet is stopped, and the alignment of the sheets in the conveyance direction is completed.

Paired width adjusting members 142, which are mounted on both sides of slanting chute 141, move perpendicular to the sheet conveyance direction. When sheet P is conveyed on the slanting surface of slanting chute 141, said paired width adjusting members 142 are opened wider than the width of sheet P, and softly contact the sides of sheet P to conduct the width alignment of sheets P.

Stapling section 150 includes stapling mechanism 150A and receiving mechanism 150B, between which sheet path 152 is formed to pass sheet P.

After two sheets P are stacked and aligned in stacker 140, stapling mechanism 150A and staple receiving mechanism 150B are driven perpendicular to the sheet conveyance direction by a driving means, which is not illustrated, whereby sheets P are stapled.

In this case, movable stopper 151 has been stopped at a position corresponding to a position where stapling mechanism 150A staples the sheet bundle stacked on movable stopper 151.

Areas having no stacking surface is formed on a portion of the sheet stacking surface of slanting chute 141, and a plurality of ejection belts 145 are entrained about driving pulley 143 and driven pulley 144, and said belts 145 rotate in arrowed direction A1 in FIG. 3.

Onto some ejection belts 145, pawl 146 is united with ejection belt 145. When ejection belts 145 are rotated, the top of pawl 146 tracks in an ellipse.

When only the stapling process is conducted, while the other processes are not conducted, a stapled bundle of sheets on ejection belts 145 is supported by pawl 146, and is conveyed obliquely upward to a nipping position of paired sheet ejecting rollers 106

Said stapled bundle of sheets is ejected and stacked on elevating sheet-ejection tray 104 by paired ejection rollers 106.

When a stapled bundle of sheets is folded to form a booklet, said bundle is folded at its center by folding section 160, and is ejected onto stationary sheet-ejection tray 105.

Folding section 160 includes paired folding rollers 161 which press the stapled sheet bundle to fold it, and pushing member 162 which pushes the center of the stapled sheet bundle between paired folding rollers 161.

Movable stopper 151 moves to a position where pushing member 162 meets the center of the stapled sheet bundle, and stops (in this state, movable stopper 151 is shown by dashed lines).

In this stopped position, pushing member 162 pushes the center of stapled sheet bundle between paired folding rollers 161, whereby the center of the stapled sheet bundle is folded, which becomes a state of a booklet.

Further, paired folding rollers 161 rotate to eject the sheet bundle in the state of the booklet onto stationary sheet-ejection tray 105.

Accumulating section 130 will be detailed later.

Figure 4:
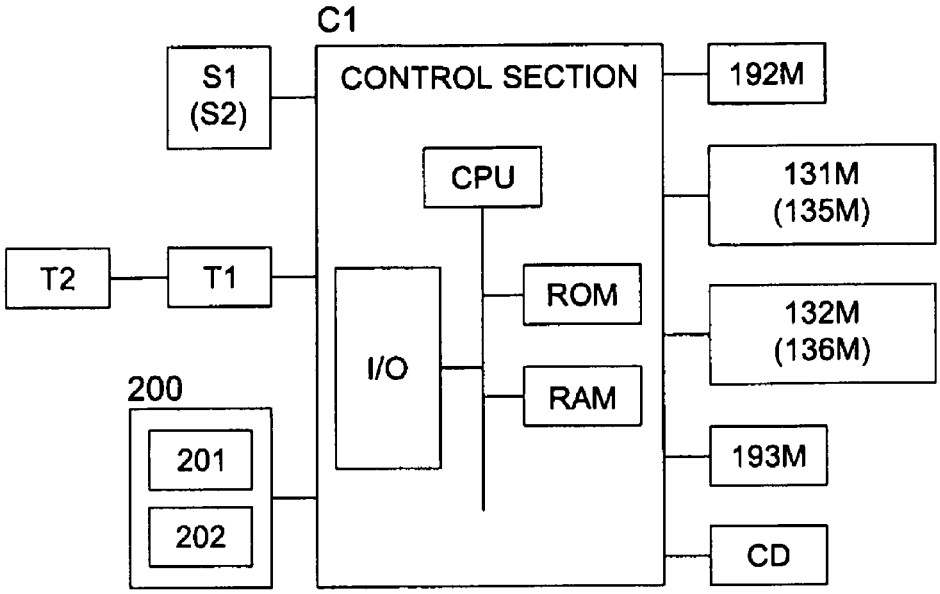
FIG. 4 is block diagram to explain the controls of the accumulating section and the stacker of the post-processing apparatus.

FIG. 4 is block diagram to explain the control of accumulating section 130 and stacker 140 of post-processing apparatus 2.

The control of post-processing apparatus will be detailed while referring to FIGS. 3 and 4.

The control described below is conducted by control section C1 of post-processing apparatus 2.

Control section C1 includes a CPU (central processing unit), RAM (random access memory), ROM (read only memory), I/O controller which controls each input-output device under the control of the CPU, and a bus which connects the above sections (see FIG. 4).

Various programs are previously stored in ROM to control post-processing apparatus 2. The CPU stores these programs into the RAM from the ROM to control each input-output device through the I/O controller.

Control section C1 is connected to first sheet sensor S1 mounted in first conveyance route A or second sheet sensor S2 mounted on fourth conveyance route D, communication section T1 which exchanges information with communication section T2 of image forming apparatus 3, and sheet conveyance length measuring section 200 which measures the conveyance length of the sheet, all of which serve as input sections.

Further, control section C1 is connected to registration roller driving motor 192M to drive registration roller 192, conveyance roller driving motor 131M to drive conveyance roller 131 or conveyance roller driving motor 134M to drive conveyance roller 135, conveyance roller driving motor 132M to drive conveyance roller 132 or conveyance roller driving motor 136M to drive conveyance roller 136, conveyance roller driving motor 193M to drive conveyance roller 193, and solenoid SD which allows conveyance roller 193 to nip the sheet or not, all of which serve as output sections.

The above-described driving motors include pulse motors, which are rotated by pulse-motor driving devices (which are not illustrated) of control section C1.

Sheet conveyance length measuring section 200 counts the driving pulses of each driving motor, and calculates to measure the conveyance length of the sheet.

Sheet conveyance length measuring section 200 includes first measuring section 201 which measures the conveyance length of the sheet conveyed through second conveyance route B, and second measuring section 202 which measures the conveyance length of the sheet conveyed through third conveyance route C.

To measure the conveyance length of the sheet conveyed through second conveyance route B, first measuring section 201 counts the driving pulses of conveyance roller driving motor 131M, whereby the conveyance length of the primary sheet conveyed through second conveyance route B is calculated.

To measure the conveyance length of the sheet conveyed through third conveyance route C, second measuring section 202 counts the driving pulses of conveyance roller driving motor 132M so that the conveyance length of the secondary sheet conveyed through third conveyance route C is calculated.

A plurality of the embodiments of accumulating section 130 will now be detailed.

Figure 5:
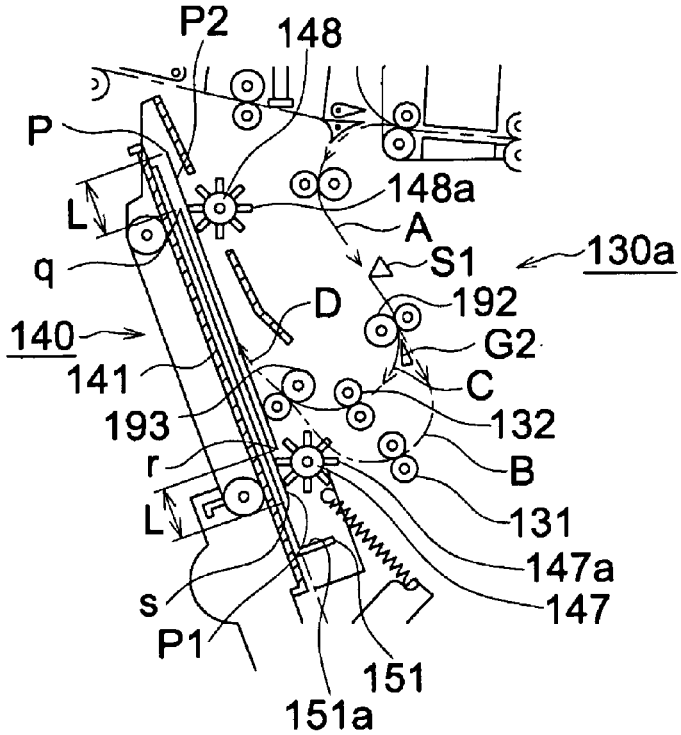
FIG. 5 is a drawing to explain the first embodiment of the accumulating section.

FIG. 5 is a drawing to explain the first embodiment of accumulating section 130.

Accumulating section 130*a* of the first embodiment includes;

second conveyance route B (being a first sheet conveyance route) through which primary sheet P1 is conveyed, third conveyance route C (being a second sheet conveyance route) through which secondary sheet P2 is conveyed, second switching gate G2 which selects second conveyance route B or third conveyance route C, paired conveyance rollers 131, serving as first conveyance members, which are mounted on second conveyance route B to convey primary sheet P1 in the downstream direction, paired conveyance rollers 132, serving as second conveyance members, which are mounted on third conveyance route C to convey secondary sheet P2 in the downstream direction, and paired conveyance rollers 193, positioned at the downstream confluent section of both second conveyance route B and third conveyance route C, which convey primary sheet P1 and secondary sheet P2, and are capable of nipping or releasing said sheets.

Further, arranged are fourth conveyance route D, positioned downstream of paired conveyance rollers 193, through which primary sheet P1 and secondary sheet P2 are conveyed, and first sheet sensor S1, positioned upstream of accumulating section 130*a*, which detects a leading edge of sheet P conveyed through first conveyance route A.

For first sheet sensor S1, a non-contact photoelectrical sensor is preferably employed to detect sheet P, which does not adversely affect the sheet conveyance.

Paired conveyance rollers 131, paired conveyance rollers 132 and paired conveyance rollers 193 are driven by pulse motors or the like. Measurement of the conveyance length of the sheet conveyed by the above-described rollers are determined by counting driving pulses given to each pulse motor.

First predetermined length L represents the difference (being a shifted length) in the conveying direction between primary sheet P1 and secondary sheet P2 which is superimposed on primary sheet P1, when both sheets are stacked on stacker 140. That is, position q of the trailing section (which exists on the opposite side of movable stopper 151) of primary sheet P1 in the conveyance direction is more advanced to movable stopper 151 at length L than position p of the trailing section (which exists on the opposite side of movable stopper 151) of secondary sheet P2.

That is, position s of the leading section (which exists near movable stopper 151) of primary sheet P1 which positions to be lower to contact slanting chute 141 when it is to be stacked on the stacker, is more advanced toward movable stopper 151 by length L than position r of the leading section (which exists near movable stopper 151) of secondary sheet P2 to be superimposed on primary sheet P1.

Length L is determined in such a way that when primary sheet P1 is urged to move toward sheet stopping surface 151*a* by urging roller 147, that is, when the sheets are stacked on stacker 140, secondary sheet P2, superimposed on primary sheet P1, does not disturb primary sheet P1, and additionally, length L is also determined based on various sections around stacker 140.

Figure 6:
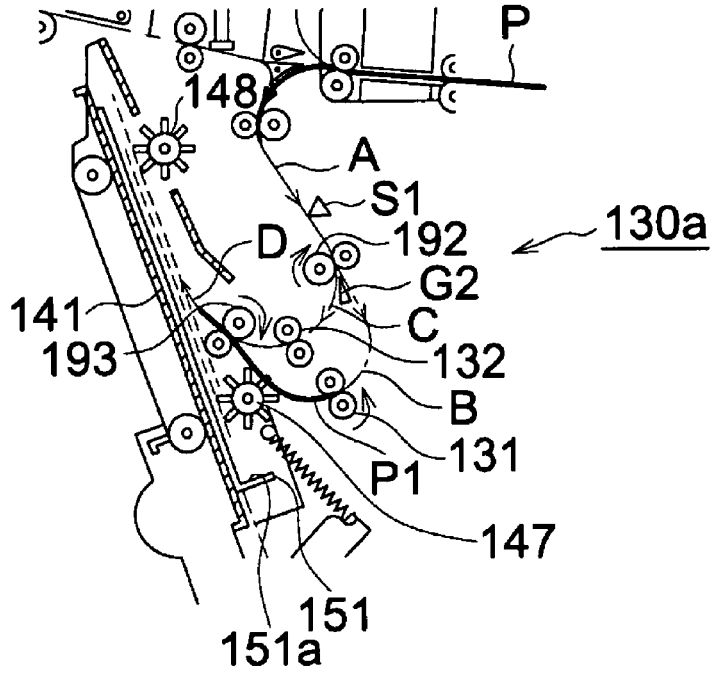
FIG. 6(*a*) is a drawing to explain the operation of the first embodiment of the accumulating section.
Figure 6:
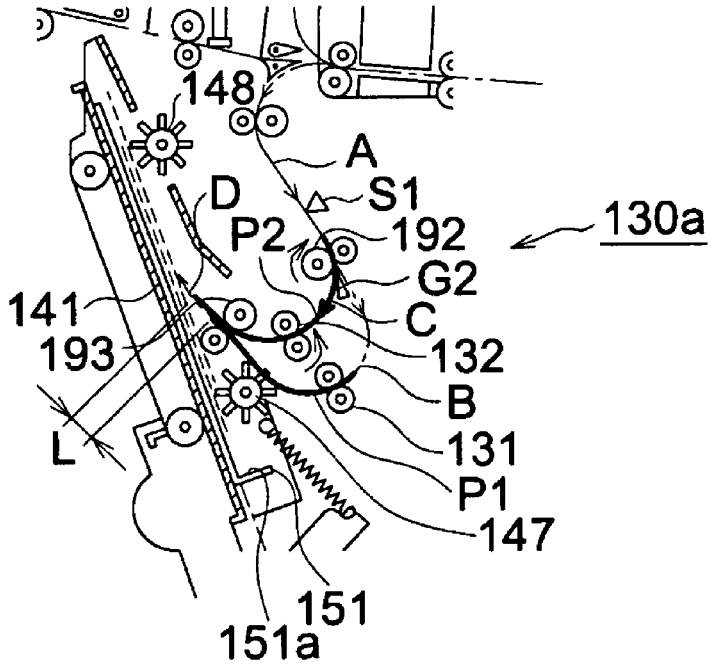

FIGS. 6(*a*) and 6(*b*) are drawings to explain the operation of the first embodiment of accumulating section 130.

The operation of accumulating section 130*a* of the first embodiment will be detailed below.

For simpler explanation, sheets exhibiting the same size, are used in this discussion.

As shown in FIG. 6(*a*), after sheet P, passing through first conveyance route A, is detected by first sheet sensor S1, second switching gate G2 is activated to open second conveyance route B through which sheet P (that is, primary sheet P1) is conveyed.

After primary sheet P1 is detected by first sheet sensor S1, paired registration rollers 131, and paired conveyance rollers 193 are normally rotated, so that primary sheet P1 is conveyed for a second predetermined length, (that is, the leading section of primary sheet P1 reaches a position which is farther downstream than paired conveyance rollers 193).

Next, as shown in FIG. 6(*b*), second switching gate G2 opens third conveyance route C.

After secondary sheet P2 is detected by first sheet sensor S1, paired registration rollers 132, and paired conveyance rollers 132 are rotated in the normal direction, so that secondary sheet P2 are conveyed for a predetermined length through third conveyance route C, (for example, the leading section of secondary sheet p2 is farther advanced at length L than the leading section of primary sheet P1 in the conveyance direction). Accordingly, in accumulating section 130*a*, secondary sheet P2 is superimposed on primary sheet P1, and the trailing section of primary sheet P1 is protruded at length L from that of secondary sheet P2 toward the upstream side.

In addition, when secondary sheet P2 is conveyed in the above-described operation, paired conveyance rollers 193 do not nip the sheets, whereby secondary sheet P2 can be superimposed on primary sheet P1.

After the conveyance of secondary sheet p2 is completed, paired conveyance rollers 193 nip both primary sheet P1 and secondary sheet P2. Paired conveyance rollers 131, paired conveyance rollers 132, and paired conveyance rollers 193 convey a sheet bundle, including superimposed sheets P1 and P2 whose positions are shifted for length L in the conveyance direction, toward slanting chute 141. Additionally, when the sheet bundle is ejected from conveyance roller 193, the trailing section of primary sheet P1 has been superimposed below secondary sheet P2, so that the trailing edge of primary sheet P1 has been shifted for length L toward the upstream direction from the trailing edge of secondary sheet P2.

In this case, in accumulating section 130*a*, primary sheet P1 represents a sheet layered under secondary sheet P2, when they are to be stacked in stacker 140. Further, secondary sheet P2 represents a sheet layered on primary sheet P1, when they are to be stacked in stacker 140.

Accordingly, in accumulating section 130*a*, concerning primary sheet P1 on which secondary sheet P2 is superimposed, the trailing edge of primary sheet P1 is shifted for length L from the trailing edge of secondary sheet P2, toward the upstream direction. Due to this length L, primary sheet P1 can be rubbed by urging roller 147 toward sheet stopping surface 151*a* in stacker 140, while secondary sheet P2 does not disturb said rubbing action conducted by urging roller 147. In more detail, leading section urging roller 147 and trailing section urging roller 148 rub superimposed primary sheet P1 and secondary sheet P2 toward sheet stopping surface 151*a*. Accordingly, primary sheet P1 and secondary sheet P2 can be surely stopped by sheet stopping surface 151*a*. By these operations, precise and effective alignment of the sheets can be conducted, and it is possible to provide post-processing apparatus 2, which can conduct high quality post-processing operations, exhibiting high productivity.

The mounting angle of slanting chute 141 looks substantially vertical in FIGS. 6(*a*) and 6(*b*), but it is also possible to mount chute 141 substantially horizontally, because urging roller 147 urges the trailing section of sheet P toward stopping surface 151*a*, so that two sheets can be stopped by stopping surface 151*a*, though chute 141 is substantially horizontal.

Figure 7:
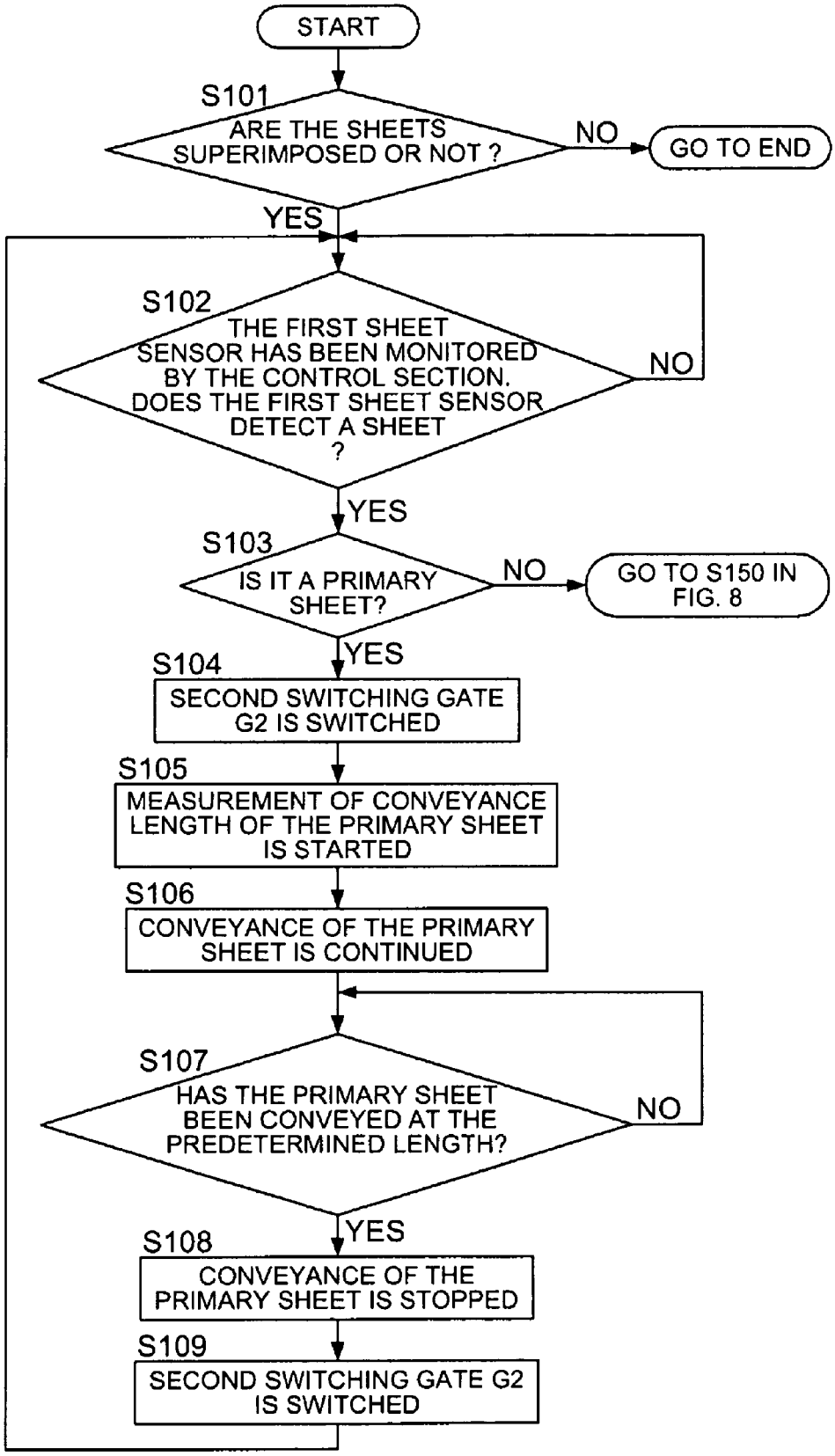
FIG. 7 is a flow chart of the first embodiment of the accumulating section.
Figure 8:
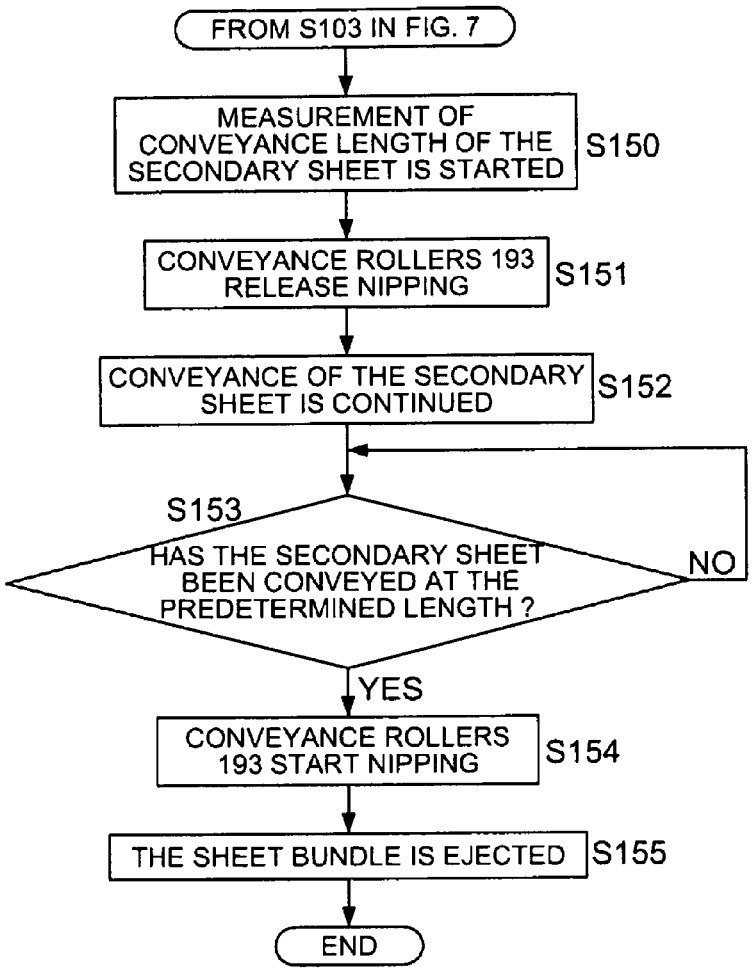
FIG. 8 is a flow chart of the first embodiment of the accumulating section.

FIGS. 7 and 8 show the flow charts of the first embodiment of accumulating section 130.

Figure 9:
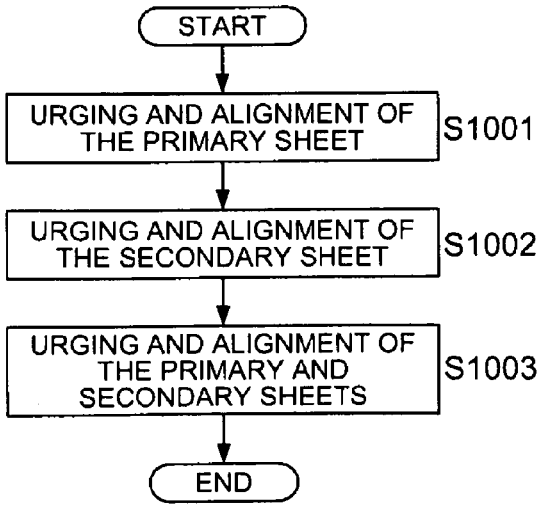
FIG. 9 is a flow chart of the stacker operation.

FIG. 9 is a flow chart of stacker 140.

The flow chart relating to the first embodiment of accumulating section 130 will be detailed while referring to FIGS. 4, 5, 7 and 8.

The operational flow described below is conducted by control section C1.

1. Judgment of the necessity of superimposing the sheets (step S101).

In FIG. 7, control section C1 determines whether sheets P are to be superimposed or not, based on post-processing content information sent from image forming apparatus 3 through communication section T1.

In detail, information is previously stored in a memory section, such as a ROM, whether the superimposing operation is necessary or not, for each of the plural post-processing operations. For example, post-processing information showing that the superimposing operation is necessary for the stapling process is sent (Yes in step S101), control section C1 determines that the superimposing operation is necessary, and advances to the next step. That is, in step S101, if the post-processing content for the previously processed sheet bundle needs predetermined time like the stapling process, and if the post-processing content for the succeeding sheet bundle uses stacker 140 like the stapling process, control section C1 determines that the succeeding sheet bundle requires the superimposing operation.

If the post-processing content which does not require the superimposing process, such as a sorting process, is sent, or if information is sent showing that third sheet P or a later sheet is to be processed, though the stapling process is shown in said information, (which is No in step S101), the operation flow jumps to END.

The operation flow to be detailed, includes that the superimposing operation is determined to be conducted, and that information of the stapling process has been sent for the post-processing operation.

2. Monitoring the first sheet sensor (step S102)

Control section C1, monitoring first sheet sensor S1 which is a first sheet detection section, detects the leading edge of sheet P (Yes in step S102), and goes to step S103, but if the leading edge is not detected (No in step S102), control section C1 repeats step S102, until the leading edge of sheet P is detected.

3. Determining Whether Sheet P is a Primary Sheet or not (Step S103)

Control section C1 determines whether detected sheet P is primary sheet P1 or not, based on an interrupting point of the job or the group. If the detected sheet is primary sheet P1 (Yes in step S103), operation flow goes to step S104. If the detected sheet is not primary sheet P1, control section C1 determines that the detected sheet is secondary sheet P2, and jumps to step S150. In addition, instead of the interrupting point of the job or the group, if the post-processing operation is changed to another post-processing operation while the job or the group is being processed, it is possible to prepare a processing flow which determines whether it is primary sheet P1 at said changing point.

4. Switching operation of second switching gate G2 (step S104)

Control section C1 selects second switching gate G2 so that primary sheet P1 is conveyed through second conveyance route B, and the operation flow goes to step S105.

5. Start of measurement of the conveyance length of primary sheet P1 (step S105)

In order to measure the conveyance length of primary sheet P1 from first sheet sensor S1, control section C1 clears the count stored in first measuring section 201 to start a new count, and the operation flow goes to step S106.

6. Continuity of the conveyance of primary sheet P1 (step S106)

Control section C1 activates registration roller driving motor 192M, conveyance roller driving motor 131M, and conveyance roller driving motor 193 to rotate in the normal direction, so that primary sheet P1 is conveyed further, and the operation flow goes to step S107.

7. Determination whether a predetermined conveyance length has been completed for primary sheet P1 (step S107)

Control section C1 monitors the count conducted by first measuring section 201, and checks whether predetermined numbers have been counted, and if the predetermined numbers have been counted (Yes in step S107), control section C1 determines that primary sheet P1 has been conveyed to a second predetermined length, and the operation goes to step S108. If the count does not reach the predetermined numbers (No in step S107), step S107 is repeated until the count reaches the predetermined numbers.

Said second predetermined length means the distance from first sheet sensor S1 to a substantially-central section between slanting chute 141 of stacker 140 and paired conveyance rollers 193 on second conveyance route B, through which primary sheet P1 is conveyed, which distance has been previously set.

8. Stop of conveyance of primary sheet P1 (step S108)

Control section C1 deactivates registration roller driving motor 192M, conveyance roller driving motor 131M, and conveyance roller driving motor 193, so that conveyance of primary sheet P1 is stopped.

Further, control section C1 clears the count in first measuring section 201, and the operation flow goes to step S109.

9. Switching operation of second switching gate G2 (step S109)

Control section C1 changes second switching gate G2 so that secondary sheet P2 is conveyed to third conveyance route C, and the operation flow goes to a next step.

10. Monitoring sheet sensor S1 in step S102, and detecting the passage of sheet P If sheet P is detected (Yes in step S102), the operation flow goes to the next step, but if it has not yet been detected (No in step S1029), control section C1 repeats step S102 until said sheet P is detected.

11. Control section C1 determines whether sheet P detected by step S103 is a primary sheet, based on the interrupting point of the job or the group. If it is primary sheet P1 (Yes in step S103), the operation flow goes to S104, and if it is not primary sheet P1, control section C1 determines that it is secondary sheet P2, and the operation flow jumps to step S150.

12. Starting the measurement of the conveyance length of secondary sheet P2 (step S150 in FIG. 8)

In order to measure the conveyance length of secondary sheet P2 from first sheet sensor S1, control section C1 clears the count in second measuring section 202, so that a new count is started, and the operational flow goes to S151.

13. Releasing the sheet nip of paired conveyance rollers 193 (step S151)

In order to superimpose secondary sheet P2 on primary sheet P1 which has been conveyed between paired conveyance rollers 193, control section C1 deactivates solenoid SD, so that the sheet nip conducted by paired conveyance rollers 193 is cancelled, and the operation flow goes to S152.

14. Continuity of the conveyance of secondary sheet P2 (step S152)

Control section C1 activates registration roller driving motor 192M and conveyance roller driving motor 132M, to rotate in the normal direction, so that secondary sheet P2 is conveyed further, and the operation flow goes to step S153.

15. Determination whether the predetermined conveyance length has been completed for secondary sheet P2 (step S153)

Control section C1 monitors the count conducted by second measuring section 202, and checks whether predetermined numbers have been counted, and if the predetermined numbers have been counted (Yes in step S153), control section C1 determines that secondary sheet P2 has been conveyed for the predetermined length, and the operation flow goes to step S154. If the count has not reached the predetermined numbers (No in step S153), step S153 is repeated until the count reaches the predetermined numbers.

Said predetermined length in step S153 means the distance, which is previously set, from first sheet sensor S1 to a position where secondary sheet P2 is advanced at length L in the conveyance direction (that is, in the downstream direction) from a position at which the leading edge of primary sheet P1 is stopped in step S108, through which secondary sheet P2 is conveyed via third conveyance route C.

16. Nipping operation conducted by paired conveyance rollers 193 (step S154)

In order to convey primary sheet P1 and secondary sheet P2, both of which are superimposed between paired conveyance rollers 193, control section C1 activates solenoid SD so that paired conveyance rollers 193 nip both primary sheet P1 and secondary sheet P2, and the operation flow goes to S154.

In addition, it is possible for the operation flow to stop both registration roller driving motor 192M and conveyance roller driving motor 132M, so that the conveyance of secondary sheet P2 is temporarily stopped.

17. Ejection of the sheet bundle (step S155)

Control section C1 controls conveyance roller driving motor 131M, conveyance roller driving motor 132M, and conveyance roller driving motor 193M, to rotate in the normal direction at the same outer circumferential velocity, so that sheet bundle P', which includes superimposed primary sheet P1 and secondary sheet P2, is ejected to an upper space of slanting stacker 140.

After both sheets P1 and P2 are nipped in step S154, each driving motor rotates in the normal direction so that the sheet is conveyed for a length which is 1.2-1.3 times the length of a sheet measured in the conveyance direction.

Subsequently, control section C1 repeats steps 101-155 until operation for the group or the job is completed.

The operation flow of stacker 140 will be detailed while referring to FIGS. 4, 5 and 9.

The operational flow described below is conducted by control section C1.

As described above, sheet bundle P', which was ejected onto the upper space of slanting stacker 140, drops onto slanting chute 141 of stacker 140, or drops onto the sheet already stacked on slanting chute 141.

1. Urging action for primary sheet P1 (step S1001)

Control section C1 activates leading section urging roller driving motor 147M in the forward direction so that leading section urging roller 147 rotates, and rubs the leading section (which is shifted length L existing in a lower section in FIG. 5) of primary sheet P1 which slides down positioned on the slanting surface of slanting chute 141.

In more detail, plural paddles 147*a* of leading section urging roller 147 rub the leading section of primary sheet P1 (which is shifted length L existing in a lower section in FIG. 5), so that primary sheet P1 is urged toward stopping surface 151*a* of movable stopper 151.

Due to this action, primary sheet P1 can be stopped by sheet stopping surface 151*a*, while secondary sheet P2 does not disturb said rubbing action of urging roller 147.

2. Urging action for secondary sheet P2 (step S1002)

Control section C1 activates urging roller driving motor 148M which drives trailing section urging roller 148, whereby urging roller 148 continuously urges secondary sheet P2, which is superimposed on primary sheet P1, toward stopping surface 151*a*.

In this action, primary sheet P1 is urged by leading section urging roller 147, and at the same time, primary sheet P1 is urged by trailing section urging roller 148 through secondary sheet P2. Further, when the leading section of secondary sheet P2 reaches leading section urging roller 147, both primary sheet P1 and secondary sheet P2 are urged by trailing section urging roller 148 and leading section urging roller 147.

In more detail, plural paddles 148*a* of leading section urging roller 148, and plural paddles 147*a* of leading section urging roller 147 rub the surface of secondary sheet P2, whereby secondary sheet P2 is urged toward stopping surface 151*a* of movable stopper 151, and primary sheet P1 is also urged through secondary sheet P2 toward stopping surface 151*a* of movable stopper 151.

3. Alignment of primary sheet P1 and secondary sheet P2 (step S1003)

Control section C1 allows motor 148M and motor 147M to continue to rotate, so that primary sheet P1 and secondary sheet P2, having touched stopping surface 151*a*, are further urged, whereby primary sheet P1 and secondary sheet P2 are completely aligned.

Control section C1 repeats steps S1001-S1003, until operation for the group or the job is completed.

Subsequently, after sheet bundle P' is completely aligned, sheet bundle P' is stapled by stapling section 150, or sheet bundle P' is folded by folding section 160, if necessary.

As detailed above, when primary sheet P1 and secondary sheet P2 are stacked in stacker 140, secondary sheet P2 is positioned on primary sheet P1.

Accumulating section 130*c* of the second embodiment will now be detailed.

Figure 10:
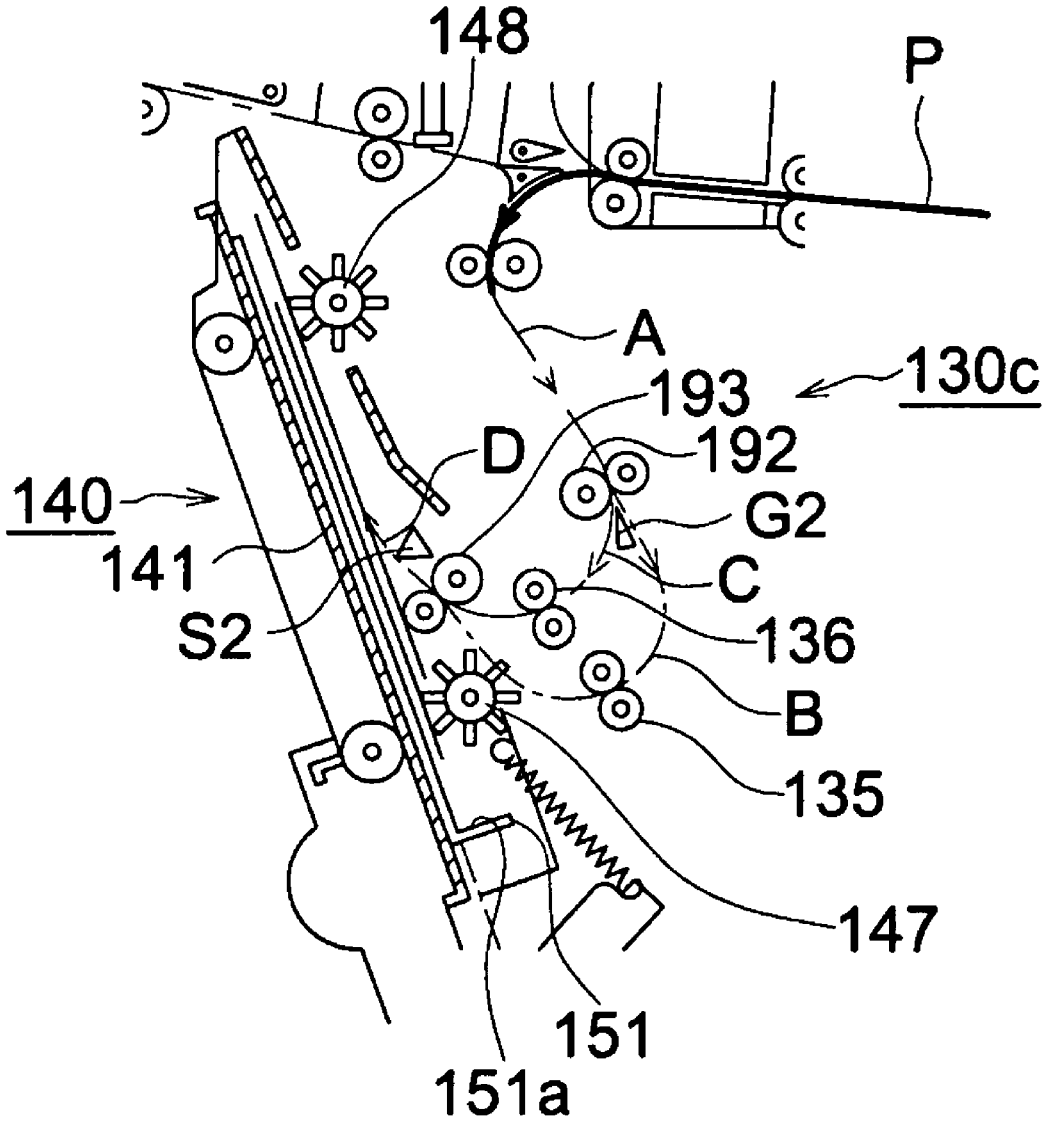
FIG. 10 is a drawing to explain the second embodiment of the accumulating section.

FIG. 10 is a drawing to explain accumulating section 130*c* of the second embodiment.

In order to avoid repeating explanation, the same matters as for the first embodiment are not detailed again.

Accumulating section 130*c* of the second embodiment includes:

paired conveyance rollers 135, serving as third conveyance members, which are mounted in second conveyance route B, and can convey primary sheet P1 both forward and backward (that is, primary sheet P1 can be switch-backed in the conveyance direction), and paired conveyance rollers 136, serving as fourth conveyance members, which are mounted in third conveyance route C, and convey secondary sheet P2.

Further, second sheet sensor S2, serving as a second sheet detecting section to detect sheet P which is conveyed through fourth conveyance route D, is mounted downstream of accumulating section 130*c*.

First sheet sensor S1 is not provided in the second embodiment.

Figure 11:
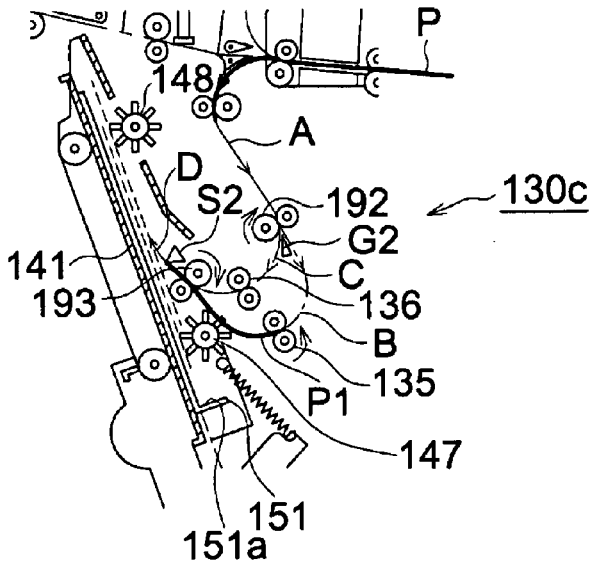
FIG. 11(*a*) is a drawing to explain the operation of the second embodiment of the accumulating section.
Figure 11:
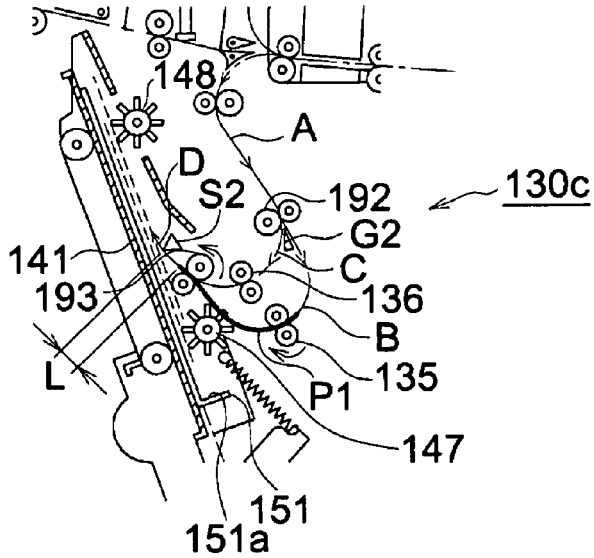
Figure 11:
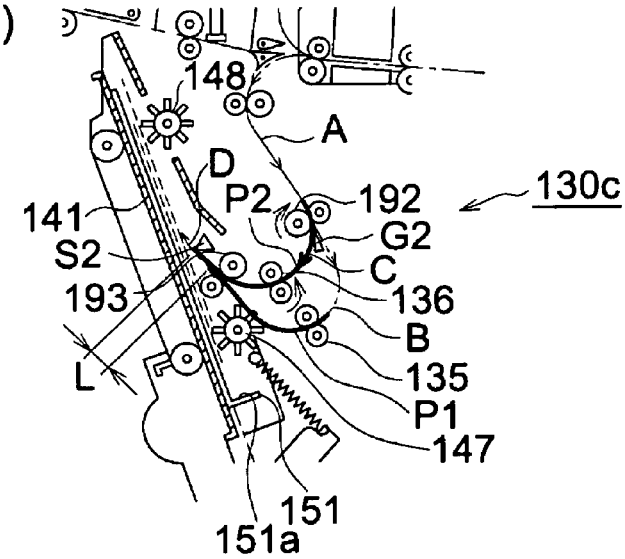

FIGS. 11(*a*) and 11(*b*) are drawings to explain the operation of accumulating section 130*c* of the second embodiment.

The operation of accumulating section 130*c* of the second embodiment will be detailed below.

As shown in FIG. 11(*a*), sheet P, which has been conveyed through first conveyance route A, is conveyed toward second conveyance route B by second switching gate G2.

Primary sheet P1 is conveyed in second conveyance route B, after which it is conveyed by paired conveyance rollers 193, whereby the leading edge of primary sheet P1 is detected by second sheet sensor S2.

After second sheet sensor S2 detects the leading section of primary sheet P1, second switching gate G2 is directed to third conveyance route C.

When primary sheet P1 is detected by second sheet sensor S2, primary sheet P1 is temporarily stopped.

As shown in FIG. 11(*b*), said temporarily stopped primary sheet P1 is conveyed backward for length L (being the first predetermined length), and is stopped.

In this state, after the conveyance length from second sheet sensor S2 is measured by the counter, the above-described backward conveyance of length L is conducted for the counts by the counter about the conveyance length from second sheet sensor S2, which is the same way as shown in steps S104-S108.

As shown in FIG. 11(*c*), secondary sheet P2 enters third conveyance route C, and is conveyed by paired conveyance rollers 136, whereby the leading edge of secondary sheet P2 is detected by second sheet sensor S2, and secondary sheet P2 stops.

In the state shown by FIG. 11(*c*), paired conveyance rollers 193 do not nip the sheet so that secondary sheet P2 is superimposed on primary sheet P1 between conveyance rollers 193.

After the conveyance of secondary sheet P2 is completed, paired conveyance rollers 193 nip both primary sheet P1 and secondary sheet P2. Then, paired conveyance rollers 193, paired conveyance rollers 135, and paired conveyance rollers 136 convey the sheet bundle, including superimposed primary sheet P1 and secondary sheet P2, toward slanting chute 141.

In addition, it is possible to structure the embodiment in such a way that when secondary sheet P2 is detected by second sheet sensor S2, conveyance of secondary sheet P2 is not instructed to stop, and superimposed primary sheet P1 and secondary sheet P2 are nipped again by paired conveyance rollers 193, and they are conveyed together in the superimposed state.

In this case, in accumulating section 130*a*, primary sheet P1 represents a sheet under secondary sheet P2, when they are to be stacked in stacker 140. Further, secondary sheet P2 represents a sheet on primary sheet P1, when they are to be stacked in stacker 140.

In addition to the effect shown in the first embodiment, in the second embodiment, since second sheet sensor S2, which is closer to stacker 140 than first sheet sensor S1 is to, is structured as the standard of position determination, primary sheet P1 and secondary sheet P2 can be more accurately shifted than in the first embodiment.

Figure 12:
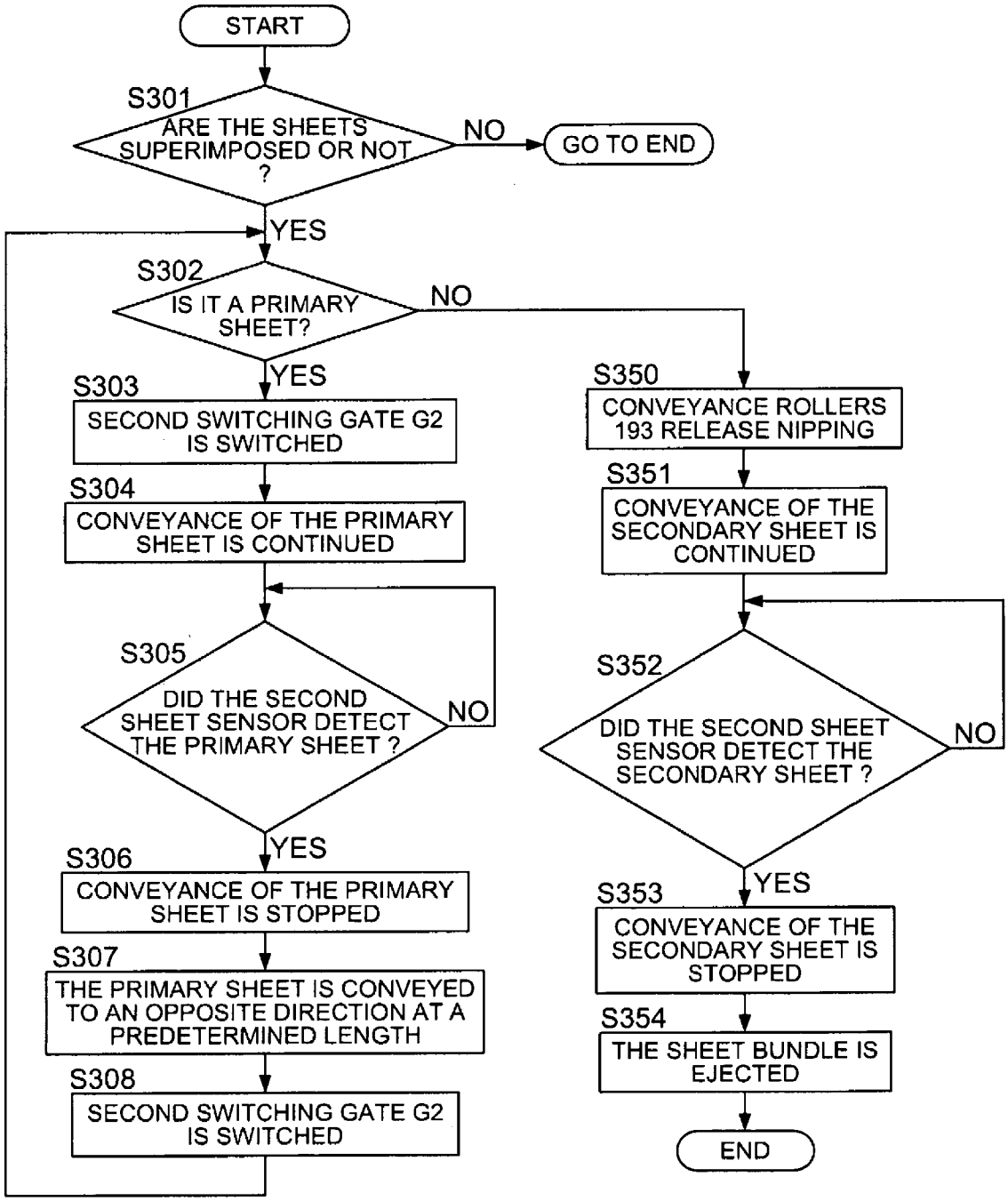
FIG. 12 is a flow chart of the second embodiment of the accumulating section.

FIG. 12 is a flow chart of the second embodiment of accumulating section 130.

1. Step S301 is conducted in the same manner as above-described step S101, accordingly explanation is omitted.

2. Step S302 is conducted in the same manner as above-described step S103, so that explanation can be omitted.

3. Step S303 is conducted in the same manner as above-described step S104, so that explanation can be omitted.

4. Step S304 is conducted in the same manner as above-described step S106, so that explanation can be omitted.

5. Monitoring of second sheet sensor S2 (step S305)

Control section C1 monitors second sheet sensor S2 which detects the leading edge of primary sheet P1. If second sheet sensor S2 detects the leading edge of primary sheet P1 (Yes in step S305), the operation flow goes to step S306, while if not (No in step S305), control section C1 repeats step S305.

6. Step S306 is conducted in the same manner as above-described step S108, so that explanation can be omitted.

7. Backward conveyance of primary sheet P1 for a predetermined length (step S307)

Control section C1 activates registration roller driving motor 192M to drive paired registration rollers 192, switch-back roller driving motor 135M to drive paired conveyance rollers 135 which can move both forward and backward, and conveyance roller driving motor 193M to drive paired conveyance rollers 193, in a backward direction, whereby primary sheet P1 is conveyed in the backward direction (that is, primary sheet P1 is switch-backed). After primary sheet P1 is conveyed in the backward direction for a predetermined first length (being shifted amount L), primary sheet P1 is stopped.

The above-described backward conveyance for length L of primary sheet P1 is conducted based on the counts counted by the counter about the conveyance length from second sheet sensor S2.

8. Step S308 is conducted in the same manner as above-described step S109, so that explanation can be omitted.

9. Steps S350-S351 are conducted in the same manner as above-described steps S151 and S152, so that explanation can be omitted.

10. Monitoring of second sheet sensor S2 (step S352)

Control section C1 monitors second sheet sensor S2 which detects the leading edge of secondary sheet P2. If second sheet sensor S2 detects the leading edge of secondary sheet P2 (Yes in step S352), the operational flow goes to step S353, while if not (No in step S352), control section C1 repeats step S352.

11. Stopping conveyance of secondary sheet P2 (step S353)

Control section C1 deactivates registration roller driving motor 192M, and conveyance roller driving motor 136M which drives paired conveyance rollers 136, whereby conveyance of secondary sheet P2 is stopped, and the operation flow goes to step S354.

12. Ejection of the sheet bundle (step 354)

The sheet bundle, which includes superimposed primary sheet P1 and secondary sheet P2, is ejected to the upper space of slanting stacker 140, which is conducted in the same way as described in step S155.

In addition, it is also possible to structure the operation in such a way that, the conveyance of secondary sheet P2 is not stopped in step S353, and after the sheet bundle, including superimposed primary sheet P1 and secondary sheet P2, is nipped between paired conveyance rollers 193 in step S354, said sheet bundle is then ejected toward the upper space of slanting stacker 140. In this structure, since the conveyance of secondary sheet P2 is not stopped, operational time is decreased, which is preferable.

Further, in the above-described first and second embodiments, two sheets are superimposed. However, for example, if the number of sheet conveyance routes in accumulating section 130 is increased, three or more sheets can be superimposed. In this occasion, control section C1 controls the accumulating section 130 and the stacker 140 in such a way that the secondary sheet superimpose on the primary sheet and a third sheet superimpose on the secondary sheet, when said three sheets are to be stacked in the stacker 140, the leading section of the secondary sheet is more advanced than the leading section of the primary sheet, and a leading section of the third sheet is more advanced than the leading section of the secondary sheet, in the accumulating section 130.

What is claimed is:

1. A post-processing apparatus, comprising:

a stacker which is adapted to stack a plurality of sheets, wherein the stacker includes:

(i) a sheet stopping member which is adapted to align the sheets, (ii) a first paddle member which is arranged adjacent to the sheet stopping member at a first predetermined position regardless of a size of the sheets in a sheet conveyance direction, wherein the first paddle member is arranged to rub a primary sheet and a secondary sheet to move the primary sheet and the secondary sheet toward the sheet stopping member, each of the primary sheet and the secondary sheet being ejected onto the stacker, and (iii) a second paddle member which is arranged to be at more than a first predetermined length from the first paddle member at a second predetermined position regardless of the size of the sheets, wherein the second paddle member is arranged in an opposite direction of the sheet stopping member with respect to the first paddle member so as to have the second paddle member rub the secondary sheet to move the secondary sheet toward the sheet stopping member, the secondary sheet being ejected onto the stacker;

an accumulating section which is positioned upstream of the stacker in the sheet conveyance direction to superimpose the plurality of sheets to be supplied to the stacker;

a sheet detection section which is positioned downstream of the accumulating section in the sheet conveyance direction to detect a sheet;

a post-processing device which is adapted to conduct a post-processing operation for the superimposed sheets ejected onto the stacker;

paired conveyance rollers which are adapted to nip the superimposed sheets after the post-processing operation to eject the superimposed sheets onto a sheet ejection tray; and a control section which controls the accumulating section, based on a sheet detection signal sent from the sheet detection section, to superimpose the secondary sheet on the primary sheet in the accumulating section such that a leading section of the primary sheet is positioned toward an upstream side in the sheet conveyance direction at the first predetermined length from a leading section of the secondary sheet, wherein the control section further controls the first paddle member to rub the leading section of the primary sheet which protrudes from the secondary sheet toward the sheet stopping member in the stacker, and still further controls the first paddle member to rub the primary sheet to move toward the sheet stopping member.

2. The post-processing apparatus of claim 1, wherein the accumulating section includes:

a first sheet conveyance route;

a second sheet conveyance route;

a first conveyance member which is adapted to convey the primary sheet in a forward direction and a backward direction, through the first sheet conveyance route; and a second conveyance member which is adapted to convey the secondary sheet through the second sheet conveyance route.

3. The post-processing apparatus of claim 2, wherein the control section:

(i) controls the first conveyance member to temporarily stop the primary sheet based on the sheet detection signal sent from the sheet detection section, (ii) controls the first conveyance member to convey the primary sheet toward an opposite direction for the first predetermined length, and (iii) controls the second conveyance member to stop the secondary sheet based on the sheet detection signal sent from the sheet detection section.

4. The post-processing apparatus of claim 1, wherein after the control section controls the first paddle member to rub the primary sheet to move downward, the control section controls the second paddle member to rub the secondary sheet to move downward.

5. An image forming system comprising:

the post-processing apparatus of claim 1; and an image forming apparatus which is adapted to supply the sheets to said post-processing apparatus.

* * * * *

UNITED STATES PATENT AND TRADEMARK OFFICE

CERTIFICATE OF CORRECTION

PATENT NO. : 7,900,905 B2
APPLICATION NO. : 12/012755
DATED : March 8, 2011
INVENTOR(S) : Tomohiro Kiriyama It is certified that error appears in the above-identified patent and that said Letters Patent is hereby corrected as shown below:

On the title page:

Item (73) Assignee;

change "Casio Computer Co., Ltd., Tokyo (JP)"
to --Konica Minolta Business Technologies, Inc., Tokyo (JP)--.

Signed and Sealed this
Sixth Day of November, 2012

David J. Kappos

David J. Kappos
*Director of the United States Patent and Trademark Office*